US005271192A

United States Patent [19]

Nothum, Sr. et al.

[11] Patent Number: 5,271,192

[45] Date of Patent: Dec. 21, 1993

[54] GUTTER HANGER AND SCREEN ASSEMBLY

[76] Inventors: Alfred Nothum, Sr., 18 Tenbrook Industrial Park, Arnold, Mo. 63010; Bradley J. Nothum, 703 Clay, Washington, Mo. 63090

[21] Appl. No.: 880,171

[22] Filed: May 6, 1992

[51] Int. Cl.[5] ..... E04D 13/06

[52] U.S. Cl. ..... 52/12; 248/48.2

[58] Field of Search ..... 52/11, 12, 13, 15, 16; 248/48.1, 48.2

[56] References Cited

U.S. PATENT DOCUMENTS

| | | | |
|---|---|---|---|
| 672,701 | 4/1901 | Daniel | 248/48.1 |
| 891,406 | 6/1908 | Cassens | 248/48.2 |
| 2,175,521 | 10/1939 | Fry | 52/12 |
| 2,209,741 | 7/1940 | Sullivan et al. . | |
| 2,636,458 | 4/1953 | Harris | 52/12 |
| 2,672,832 | 3/1954 | Goetz | 52/12 |
| 3,351,206 | 11/1967 | Wennerstrom . | |
| 3,416,760 | 12/1968 | Sauder . | |
| 3,436,878 | 4/1969 | Singer . | |
| 4,043,527 | 8/1977 | Franzmeier | 52/11 |
| 4,210,301 | 7/1980 | Weiss | 52/16 |
| 4,351,134 | 9/1982 | Clarkson . | |
| 4,467,570 | 8/1984 | Kriegel . | |
| 4,553,356 | 11/1985 | Pepper . | |
| 4,907,381 | 3/1990 | Ealer | 52/12 |
| 4,941,299 | 7/1990 | Sweers . | |
| 5,040,750 | 8/1991 | Brant | 248/48.2 |
| 5,044,581 | 9/1991 | Dressler | 248/48.1 |

FOREIGN PATENT DOCUMENTS 3905961 9/1989 Fed. Rep. of Germany ..... 52/12

*Primary Examiner*—Michael Safavi

*Attorney, Agent, or Firm*—Rogers, Howell & Haferkamp

[57] ABSTRACT

An improved gutter hanger and leaf screen assembly is comprised of hangers formed with holes and grooves at their rearward ends for attachment of the hangers to the eave of a roof. The holes in the hangers are provided for the insertion of fasteners such as nails or wood screws therethrough, and the grooves are provided to position the fasteners in the holes by first inserting a tip of the fastener in the groove and sliding the fastener tip along the groove until it falls into the hole. The hangers are also provided with forwardly projecting tabs which facilitate the attachment of the leaf screen of the assembly onto the hangers and secure the rearward ends of the leaf screen on the hangers. The leaf screen of the assembly is formed with folds at its forward and rearward edges that are provided to securely hold the leaf screen on the hangers. Opposite left and right side edges of the leaf screen are also provided with flaps that overlap adjacent leaf screens when several screens are assembled side by side over the top openings of gutters. The overlapping flaps prevent gaps from forming between adjacent leaf screens and prevent leaves or other debris from falling through gaps between adjacent leaf screens.

16 Claims, 1 Drawing Sheet

FIG. 1.
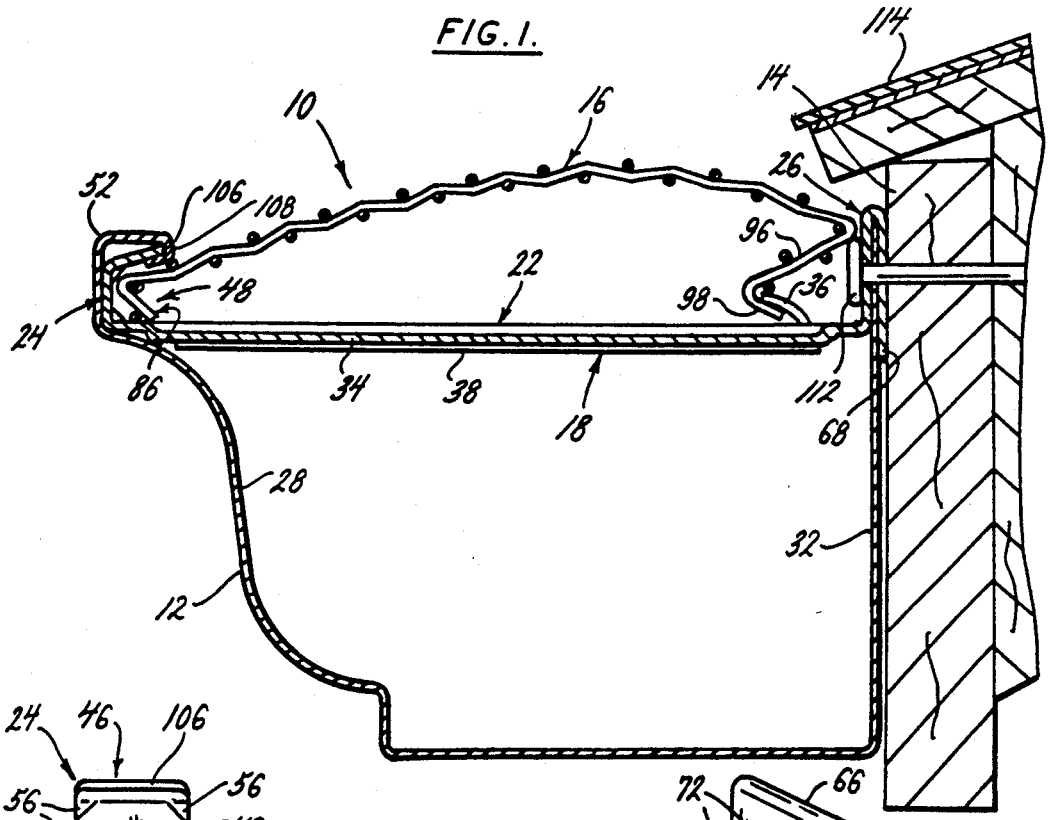
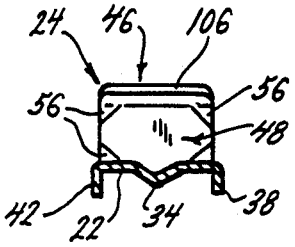
FIG. 3.
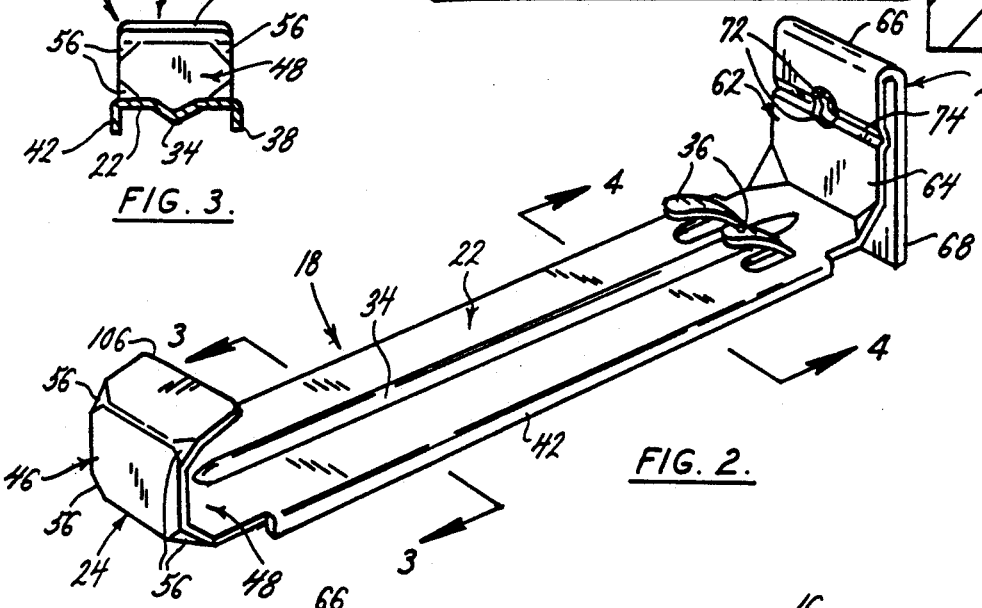
FIG. 2.
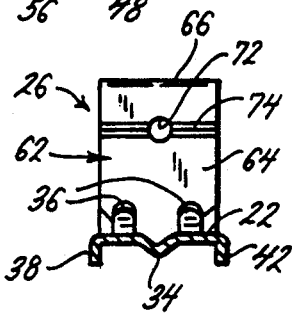
FIG. 4.
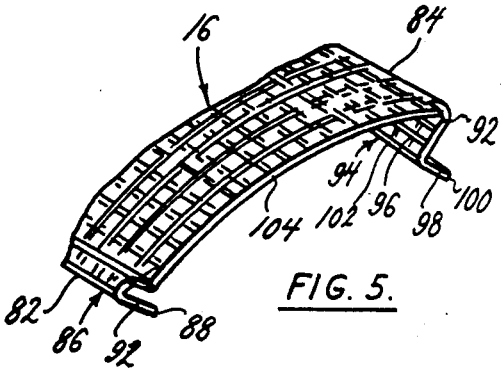
FIG. 5.

GUTTER HANGER AND SCREEN ASSEMBLY

BACKGROUND OF THE INVENTION (1) Field of the Invention

The present invention pertains to a hanger and screen assembly for use with rain gutters. In particular, the present invention pertains to a hanger and screen assembly that is assembled with a conventional rain gutter to protect the gutter from clogging with leaves and/or other debris. The hanger is specifically configured to facilitate the installation of the screen over the top opening of the gutter and the screen is specifically configured to overlap like screens at its opposite ends to provide a continuous screen cover over the gutter opening with no gaps between adjacent screens.

(2) Description of the Related Art

It is a well known practice to place lengths of screen over the top openings of gutters to protect the gutters from becoming clogged with leaves and/or other debris. Various different types of gutters, gutter hangers, and screens have been developed in the prior art for the purpose of preventing leaves and other debris washed off of roof surfaces from collecting inside gutters bordering the roof surfaces, and for the purpose of facilitating the assembly of the gutters, gutter hangers, and screens to the eaves of the roof.

An example of a prior art gutter and gutter hanger is disclosed in U.S. Pat. No. 3,416,760. The gutter hanger disclosed in this patent is typical of prior art hangers. A disadvantage associated with prior art hangers is that, when the gutter and hanger are assembled to the roof eave from the roof, it is difficult for the workman to lean over the edge of the roof to locate the gutter and gutter hanger in their proper positions against the eave and secure the gutter and gutter hangers to the eave. Very often the workman will only reach over the edge of the roof to locate the gutter and gutter hanger against the eave and then attempt to fasten the gutter hanger to the eave with a fastener such as a nail or wood screw without actually being able to see the end of the gutter hanger being attached to the eave. Often this will result in the gutter and gutter hanger being attached to the eave in improper positions relative to each other, and at times this will result in the workman completely missing the gutter hanger with the fastener as the fastener is driven into the eave.

What is needed to overcome this disadvantage of prior art gutters and gutter hangers is an improved gutter hanger with a means of positively locating a fastener such as a nail or wood screw in a hole of the gutter hanger to attach the hanger to the eave without requiring that the workman view the gutter hanger hole to locate the fastener in the hole.

Examples of typical prior art gutter screens are disclosed in U.S. Pat. Nos. 2,209,741 and 4,907,381. Many prior art gutter screens have a forward edge specifically configured to be attached to a forward edge of a particular gutter. These screens are disadvantaged in that they likely are not capable of being used with other gutters not having the specific forward edge configuration for the screen. Moreover, many prior art gutter screens of this type are disadvantaged in that it is difficult to attach the forward edge configuration of the gutter screen to the forward edge of the gutter along the entire length of the screen section.

Many prior art gutter screens are also disadvantaged in that they do not comprise any means of retaining the rearward edge of the screen over the top opening of the gutter. These types of prior art gutter screens have rearward edges that are free to move up away from the top opening of the gutter and often become separated from the gutter after a period of use. Still further, many prior art gutter screens are disadvantaged in that they are designed to be assembled over the top opening of a gutter in an end-to-end relationship. After a period of time, the sections of screen tend to separate from each other forming gaps between adjacent lengths of screen that enable leaves and other debris washed from the roof surface to pass through the gaps and possibly clog the gutter.

What is needed to overcome the above set forth disadvantages of prior art gutter leaf screens is a leaf screen that is specifically designed to be used with a particular gutter hanger, where the forward edge of the leaf screen is configured to be engaged against and retained by a front section of the gutter hanger specifically configured to receive the forward edge of the leaf screen, and the rearward section of the hanger is provided with tabs that project upward and forward from the hanger and engage the rearward edge of the screen to retain the screen rearward edge on the hanger.

SUMMARY OF THE INVENTION

The present invention overcomes the disadvantages associated with prior art gutter hanger and screen assemblies by providing an improved hanger and screen assembly with gutter hangers having specific configurations designed to facilitate the installation of the screens on the hangers and retain the screens on the hangers as well as facilitating the assembly of the hangers on a roof eave, and screen lengths having specific configurations to facilitate the attachment of the screens on the hangers and to overlap adjacent screen lengths to prevent gaps from forming between adjacent screens.

The gutter hanger of the present invention includes a middle section dimensioned to span across the top opening of a conventional gutter between the back wall and front wall of the gutter. A front section of the hanger is connected to the forward end of the hanger middle section and has a specific configuration designed to engage inside the top edge of the front wall of a conventional gutter. The front section has a general C-shaped configuration with the opening of the C-shaped configuration facing rearwardly toward the hanger middle section. The opening is provided to receive a forward edge of the screen and to retain the screen forward edge.

One or more tabs are provided on the middle section of the hanger toward the rearward end of the hanger. The tabs extend upwardly and forwardly from the middle section and are provided to engage the rearward edge of the screen. The rearward edge of the screen is wedged between the tabs and the hanger middle section and is secured in this position over the gutter top opening by the tabs.

The sections of screen are easily inserted on the hanger and over the top gutter opening by first inserting the forward edge of the screen inside the C-shaped front section of the hanger, and then inserting the rearward edge of the screen between the tabs and the middle section of the hanger. The screen is slightly bent across its lateral width as it is assembled on the hangers and the resiliency of the screen causes the screen front edge and rear edge to engage between the front section and the tabs of the hanger thereby securely attaching the screen on the hanger.

A rearward section of the hanger is configured to engage over the top of a conventional gutter backwall. The rearward section extends upwardly from the rear end of the hanger middle section, over the gutter backwall, and then downward behind the gutter backwall. A hole is provided completely through the rearward section of the hanger to accommodate a fastener such as a nail or wood screw. The nail or wood screw is passed through the hole in attaching the hanger to the eave of a roof. A substantially horizontal transverse groove is formed in the rear section of the hanger. The groove intersects the hole at the center of the hanger rear section and facilitates the locating of a fastener in the hole by guiding a tip of the fastener along the groove until it is inserted through the hanger hole.

The front middle and rear sections of the hanger are formed unitarily and are preferably formed of metal.

BRIEF DESCRIPTION OF THE DRAWINGS

Further objects and features of the present invention are revealed in the following detailed description of the preferred embodiment of the invention and in the drawing figures wherein:

FIG. 1 is a side elevation view, in section, of the gutter hanger and leaf screen assembly of the present invention assembled with a conventional gutter to the eave of a roof;

FIG. 2 is a perspective view of the gutter hanger of the present invention;

FIG. 3 is an end view, in section, of the gutter hanger taken along the line 3—3 of FIG. 2;

FIG. 4 is an end view, in section, of the hanger of the present invention taken along the line 4—4 of FIG. 2; and FIG. 5 is a partial view showing the right hand of the leaf screen of the present invention.

DESCRIPTION OF THE PREFERRED EMBODIMENT

FIG. 1 shows the gutter hanger and leaf screen assembly 10 of the present invention assembled to a conventional gutter 12 and supporting the gutter on the eave 14 of a roof. The hanger and screen assembly of the invention is basically comprised of a plurality of screen lengths 16 (only one of which is shown in FIG. 1) and a plurality of hangers 18 (only one of which is shown in FIG. 1). For simplicity, only one screen length 16 and one hanger 18 will be described. Preferably, both the screen length and hanger are constructed from metal However, other types of materials may be employed in constructing the screen and hanger of the present invention.

The hanger 18 of the assembly is shown in FIG. 2. The hanger is basically comprised of a middle section 22 having opposite forward and rearward ends, a forward section 24 connected at the forward end of the middle section, and a rearward section 26 connected at the rearward end of the middle section.

The middle section 22 is an elongated member having a predetermined length sufficient to span laterally across the top opening of a gutter 12 between the forward wall 28 and rearward wall 32 of the gutter. A center ridge 34 is formed in the middle section 22 to provide reinforcement to the middle section. A pair of tabs 36 are formed in the middle section on opposite sides of the ridge 34 and adjacent the rearward end of the middle section. The tabs 36 are substantially identical and are formed by a pair of U-shaped cuts made through the middle section with the portions of the middle section defined by the cuts being bent upward from the middle section. As is best seen in FIG. 1, the tabs 36 extend upwardly and forwardly of the middle section 22. As is best seen in FIGS. 3 and 4, the opposite longitudinal sides 38, 42 of the middle section 22 are bent downwardly to form reinforcing flanges extending along the lateral length of the middle section.

The forward or front section 46 of the hanger 18 is formed unitarily with the front end of the hanger middle section 22. As seen in FIGS. 1 and 2, the front section 46 has a general C-shaped configuration with the opening 48 of the C-shaped configuration facing rearwardly toward the hanger middle section 22. The dimensions of the hanger front section 46 are determined to enable the front section to be easily inserted into an edge channel 52 formed along the top edge of the front wall of many conventional gutters. The dimensions of the front section 46 are also determined to facilitate the engagement of the front edge of the screen 16 of the present invention inside the C-shaped opening 48 of the front section as will be explained. As is best seen in FIGS. 2 and 3, the bends formed in the hanger front section 46 to produce the C-shaped configuration are provided with gussets 56 at their opposite ends. The gussets 56 formed at the opposite ends of the bends reinforce the bends and the front section 46 of the hanger.

The rearward or rear section 62 of the hanger 18 is formed unitarily with the rearward end of the hanger middle section 22 and extends upwardly from the middle section rearward end. The rear section 62 of the hanger is specifically configured to engage over the top edge of a backwall 32 of a conventional gutter. The rear section 62 is formed with an upwardly extending front portion 64, a bend portion 66 at the top most end of the front portion 64, and a rear portion 68 extending downwardly from the bend 66 behind the front portion 64. The front and rear portions 64, 68 and the connecting bend 66 of the hanger rear section 62 give the rear section a general inverted U-shaped configuration that enables the rear section 62 to be easily fastened over the top edge of a gutter backwall 32.

A pair of coaxial holes 72 extend through both the front and rear portions 64, 68 of the hanger rear section 62. As seen in FIGS. 2 and 4, the holes 72 are centered in the rear section 62. A groove 74 is formed in the front portion 64 of the rear section 62. The groove 74 extends transversely across the rear section front portion 64 and intersects the forward most of the holes 72 at a midpoint of the groove. The groove is provided to facilitate the insertion of a fastener such as a nail or wood screw in the hole 72 as will be explained.

The screen 16 of the present invention has a general rectangular configuration defined by a front edge 82 formed by a forward most fold in the screen and a rear edge 84 formed by a rearward most fold in the screen. A front screen flange 86 is formed between the front edge fold 82 and the front end 88 of the screen. The front flange 86 formed by the front edge fold 82 extends beneath the screen along the entire longitudinal length of the screen 16 between a left side edge (not shown) and an opposite right side edge 92 of the screen.

A rearward flange 94 is formed between the rearward most fold at the rear edge 84 of the screen and the rear end 100 of the screen. As seen in FIG. 5, the screen rear flange 94 is formed from a first section 96 of the screen that is folded under the screen at the rear edge 84 fold line, and a second section 98 of the screen that is folded underneath the first section 96 along a second fold line 102. The first section 96 of the flange extends beneath the screen 16 in a forward direction and the second section 98 of the flange extends beneath both the screen and the flange first section in a rearward direction. The general Z-shaped cross section of the screen rear flange 94 gives the rear flange a resiliency that biases the rear edge 84 of the screen in an upward direction.

Left and right flaps or tabs 104 (only the right tab is visible in FIG. 5) are provided at the opposite left and right side edges 92 of the screen. As is best seen in FIG. 5, the flaps 104 are formed only on that portion of the screen left and right side edges between the front edge 82 and the rear edge 84 of the screen. Preferably, the flaps 104 extend completely across the lateral width of the screen between the front edge 82 and rear edge 84. The flap shown in FIG. 5 does not extend to the front and rear edges 82, 84 of the screen to provide a better view of the forward and rearward most folds and the front and rear flanges formed in the screen by the folds. It should be understood that in the preferred embodiment of the screen 16, the left and right flaps 104 extend from the front edge 82 of the screen to the back edge 84 of the screen. The left and right flaps 104 are provided at the left and right side edges 92 of the screen to overlap between adjacent screen lengths as will be explained.

In assembling the gutter hanger and screen assembly 10 of the present invention to a conventional gutter, and in mounting the assembly and the gutter to the eave 14 of a roof, the hanger 18 is first assembled to the gutter 12. As seen in FIG. 1, in assembling the hanger 18 to the gutter the front section 46 of the hanger is first inserted inside the edge channel 52 of the gutter. The front section 46 is easily inserted into the edge channel 52 of the gutter by first positioning the hanger 18 in a general vertical orientation relative to the gutter front channel 52 as viewed in FIG. 1. In this orientation of the hanger 18, the forward most end 106 of the hanger is engaged beneath the underside of the gutter channel 52. The hanger is then rotated in a clockwise direction as viewed in FIG. 1, causing the forward most end 106 of the hanger front section 46 to engage inside the lip 108 formed at the top end of the gutter channel 52. As the hanger is rotated clockwise, the C-shaped configuration of the front section 46 wedges, inside the channel 52 at the top edge of the gutter front wall 28.

Simultaneously with the attachment of the hanger front section 46 inside the gutter channel 52, as the hanger 18 is rotated clockwise the rear section 62 of the hanger is engaged over the top edge of the gutter backwall 32 with the bend 66 of the rear section engaging over the top edge of the gutter back wall and the front and rear portions 64, 68 engaging over front and rear surfaces of the back wall. With the hanger 18 assembled to the gutter 12 in the relative positions of the hanger and gutter shown in FIG. 1, the hanger and gutter are ready to be secured to the eave 14 of the roof.

In assembling the hanger and gutter to the eave, the back wall 32 of the gutter and the rear portion 68 of the hanger rear section are placed in their desired position against the eave 14. Most gutters, including that of the present invention, are hung from the roof. The workman on the roof cannot see the hanger because the roof shingles hang over the gutter hanger and obstruct the workman's view. The workman assembling the hanger and gutter to the eave inserts a fastener, such as the nail 112 shown in FIG. 1, into the holes 72 through the hanger rear section and drives the nail into the eave 14 thereby securing the hanger and the gutter to the eave. The groove 74 provided in the hanger rear section assists the workman when the hanger and gutter are assembled to the eave by a workman on the roof 114. The workman need only reach over the edge of the roof and feel for the groove 74 provided in the hanger rear section 62 without actually seeing the groove 72. The workman then places the tip of the fastener 112 in the groove 74 and slides the fastener tip along the groove until it falls into the holes 72 provided through the hanger rear section 62. In this manner, the groove 74 provided in the rear section of the hanger assists the workman in locating the fastener in the hanger hole 72 without requiring that the workman actually see the hole, thus greatly facilitating attachment of the hanger and gutter to the eave from the roof.

Once the hanger 18 and gutter 12 have been attached to the eave 14, the lengths of screen 16 are assembled on the hanger. In assembling the screen 16 on the hanger 18, the front flange 86 is first inserted inside the opening 48 of the C-shaped hanger front section 46. The resiliency of the screen at the front edge 82 formed by the forward most fold enables the front flange 86 to be resiliently bent toward the underside of the screen along the front edge 82 to wedge the screen front edge 82 securely in the opening 48 of the hanger front section 46 and inside the channel 52 of the gutter.

With the front edge 82 of the screen secured in the hanger front section 46 and the gutter channel 52, the screen is then bent slightly across its lateral width to position the rearward end 100 of the screen in a position just forward of the pair of tabs 46 of the hanger 18. The rearward end 100 of the screen is then inserted between the hanger middle section 22 and the tabs 36 to securely wedge the rearward end 100 between the middle section and tabs. The engagement of the screen rearward end 100 between the hanger middle section 22 and the tabs 36 securely holds the rear of the screen on the hanger.

The resiliency of the screen across its lateral width maintains the engagement of the screen front edge 82 inside the hanger front section 46 and the gutter channel 82 and also maintains the engagement of the screen rear end 100 between the hanger middle section 22 and the tabs 36. The general Z-shaped configuration of the rear of the screen 16 biases the rear screen edge 84 upward toward the end of the roof 14 to position the screen 16 as a continuation of the roof surface. The Z-shaped configuration of the rear end of the screen also enables the screen to extend rearwardly covering the entire gutter top opening while still providing the positive engagement between the rear end 100 of the screen and the hanger middle section 22 and tabs 36.

In the preferred embodiment of the invention, each screen length 16 extends longitudinally along the gutter for about four feet. Larger or smaller longitudinal lengths of screen 16 may be employed if so desired. When assembling screen lengths side by side on the hangers 18 of the present invention, the left side edge of one screen will abut up against the right side edge of an adjacent screen with the flaps or tabs 104 overlapping. This ensures that no gaps are provided between adjacent lengths of screen for leaves or other debris to fall between.

While the present invention has been described by reference to a specific embodiment, it should be understood that modifications and variations of the invention may be constructed without departing from the scope of the invention defined in the following claims.

What is claimed is:

1. A gutter hanger and screen assembly for attachment between front and back walls of a gutter with the hanger spanning a top opening of the gutter and supporting the screen over the top opening to prevent leaves and other debris from falling into the gutter, the hanger and screen assembly comprising:

a hanger having an elongated middle section with opposite front and rear ends, the middle section having a length between its front and rear ends sufficient to laterally span a top opening of a gutter between front and back walls of the gutter, a front section connected to the front end of the middle section and having a configuration for attachment of the front section to the front wall of the gutter, a rear section connected to the rear end of the middle section and having a configuration for attachment of the rear section to the back wall of the gutter, and at least one tab extending upward from the middle section intermediate the front and rear ends; and, a screen having a longitudinal length between opposite left and right side edges of the screen and having, a lateral width between a front edge and a back edge of the screen, the front edge of the screen engaging against the front section of the hanger and the back edge of the screen engaging against the tabs, the lateral width of the screen being sufficient to enable the front edge and back edge of the screen to engage against the front section and the tab of the hanger with the screen being bent in an arc across its width, where resilience of the screen maintains engagement of the front edge and back end against the front section and the tab.

2. The assembly of claim 1, wherein:

a left flap projects longitudinally from the left side edge of the screen and a right flap projects longitudinally from the right side edge of the screen, the left flap is configured to overlap a right flap on a like screen and the right flap is configured to overlap a left flap on a like screen.

3. The assembly of claim 2, wherein:

the left flap and the right flap both have lateral widths substantially equal to the lateral width of the screen between the front and back edges of the screen.

4. The assembly of claim 1, wherein:

the tab is formed unitarily with the middle section and forms a forward opening notch between the tab and the middle section for receipt of the screen back edge.

5. The assembly of claim 1, wherein:

a second tab extends upwardly from the middle section adjacent the one tab, the one tab and the second tab are substantially identical and are positioned side by side on the middle section of the hanger.

6. The assembly of claim 1, wherein:

the rear section of the hanger extends upwardly relative to the middle section and a hole is provided through the rear section to accommodate a fastener, and a groove is formed in the rear section intersecting the hole to facilitate insertion of a fastener through the hole by enabling a tip of the fastener to be guided along the groove to the hole.

7. The assembly of claim 6, wherein:

the hole is centered in the rear section and the groove extends transversely across the rear section with the hole being positioned at a midpoint of the groove.

8. A gutter hanger for attachment to front and back walls of a gutter with the hanger spanning a top opening of the gutter and for supporting a length of screen over the gutter top opening to prevent leaves and other debris from falling into the gutter, the hanger comprising:

an elongated middle section with opposite front and rear ends, the middle section having a length between its front and rear ends sufficient to span a top opening of a gutter between front and back walls of the gutter;

a front section connected to the front end of the middle section and having a configuration for attachment of the front section to the front wall of the gutter to support the front wall;

a rear section connected to the rear end of the middle section and having a configuration for attachment of the rear section to the back wall of the gutter to support the back wall;

at least one tab extending upward from the middle section intermediate the front and rear ends, the tab being configured to engage a back edge of a length of screen having front and back edges with the front edge of the screen abutting against the front section and the screen being bent in an arc across its width, where resiliency of the screen maintains engagement of the front and back edges of the screen between the front section and tab of the hanger bracket; and, the rear section extends upwardly relative to the middle section and a hole is provided through the rear section to accommodate a fastener, and a groove is formed in the rear section intersecting the hole to facilitate insertion of a fastener through the hole by enabling a tip of the fastener to be guided along the groove to the hole.

9. The hanger bracket of claim 8, wherein:

a middle section, the front section, the rear section, and the tab are all formed as unitary parts of the hanger bracket.

10. The hanger bracket of claim 8, wherein:

the tab is formed unitarily with the middle section and forms a forward opening notch between the tab and the middle section for receipt of the back edge of the screen therein.

11. The hanger bracket of claim 8, wherein:

a second tab extends upwardly from the middle section intermediate its front and rear ends and adjacent the one tab, the one and the second tabs are substantially identical and are positioned side by side on the middle section.

12. The hanger bracket of claim 8, wherein:

the hole is centered in the rear section and the groove extends transversely across the rear section with the hole being positioned at a midpoint of the groove.

13. A gutter hanger bracket for attachment to front and back walls of a gutter with the hanger spanning a top opening of the gutter and for supporting a length of screen over the gutter top opening to prevent leaves and other debris from falling into the gutter, the hanger bracket comprising:

an elongated middle section with opposite front and rear ends, the middle section having a length between its front and rear ends sufficient to span a top opening of a gutter between front and back walls of the gutter;

a front section connected to the front end of the middle section and having a configuration for attachment of the front section to the front wall of the gutter to support the front wall;

a rear section connected to the rear end of the middle section and having a configuration for attachment of the rear section to the back wall of the gutter to support the back wall, the rear section extending upwardly relative to the middle section and having a hole extending therethrough to accommodate a fastener;

a groove formed in the rear section intersecting the hole, the groove being provided to facilitate insertion of a fastener through the hole by enabling a tip of he fastener to be guided along the groove to the hole; and, the hole is centered in the rear section and the groove extends transversely across the rear section with the hole being positioned at a midpoint of the groove.

14. A gutter screen for attachment between front and back walls of a gutter with the screen spanning over a top opening of the gutter to prevent leaves and other debris from falling into the gutter, the screen comprising:

a front edge configured to be engaged inside a front wall of a gutter;

a back edge configured to be engaged inside a back wall of the gutter;

the screen having a lateral width between the front and back edges sufficient to enable the front and back edges to be positioned between the front wall and back wall of the gutter with the screen being bent in an arc across its width; and, the screen having a predetermined longitudinal length with a left side edge and a right side edge at opposite ends of the longitudinal length, and the screen having a left flap projecting longitudinally from the left side edge and a right flap projecting longitudinally from the right side edge, the left flap being configured to overlap a right flap on a like screen and the right flap being configured to overlap a left flap on a like screen; and, a rear flange is connected to the screen along the back edge of the screen, the flange is bent in a forward direction along the back edge of the screen and a first section of the flange extends forwardly beneath the screen to a fold line formed in the rear flange, the fold line extended longitudinally across the rear flange, and a second section of the flange is connected to the first section of the flange along the fold line, the second section of the flange extends rearwardly beneath the first section of the flange to a rear end of the screen positioned below the screen and the first and second sections of the rear flange, and positioned forwardly of the screen back edge and rearwardly of the fold line, the bends along the back edge of the screen and the fold line giving the rear flange a resilience that biases the rear end of the screen away from an underside of the screen.

15. The screen of claim 14, wherein:

the left flap and the right flap both have lateral widths substantially equal to the lateral width of the screen between the front and back edges.

16. The screen of claim 14, wherein:

a front flange is connected to the screen along the front edge of the screen, the flange is bent in a rearward direction along the front edge of the screen and extends rearwardly beneath the screen to a front end of the screen positioned below and rearward of the screen front edge, the bend along the front edge of the screen giving the front flange a resilience that biases the front end of the screen away from an underside of the screen.

* * * * *